United States Patent [19]

Kaveckis et al.

[11] Patent Number: 4,976,075

[45] Date of Patent: Dec. 11, 1990

[54] ROOF HINGE ARRANGEMENT AND METHOD OF USING SAME FOR MODULAR HOUSING

[76] Inventors: Joseph E. Kaveckis, 1365 York Avenue, Box 120, New York, N.Y. 10021; S. Roy Pertchik, 429 East 9th Street, Apt. 1, New York, N.Y. 10009

[21] Appl. No.: 309,616

[22] Filed: Feb. 10, 1989

[51] Int. Cl.[5] ..... E04B 1/344

[52] U.S. Cl. ..... 52/71; 52/90; 52/741

[58] Field of Search ..... 52/641, 646, 66, 71, 52/79.5, 123.1, 741, 90; 16/225, 226, 227

[56] References Cited

U.S. PATENT DOCUMENTS 4,163,303 8/1979 Hanna ..... 16/227

4,179,857 12/1979 Danford ..... 52/71

4,512,120 4/1985 Lindal ..... 52/66 X 4,619,304 10/1986 Smith ..... 16/227 X

*Primary Examiner*—John E. Murtagh

*Attorney, Agent, or Firm*—Frishauf, Holtz, Goodman & Woodward

[57] ABSTRACT

An arrangement for pivotally securing a roof panel to the upper end of a housing frame, includes a plate fixedly secured to the upper end of a ceiling panel or wall panel of the housing frame; a rocker secured to the roof panel and positioned on the plate; and flexible hinge band wrapped and secured about the plate and rocker in a substantially figure eight configuration for permitting pivotal movement of the rocker on the plate along two different pivot axes to allow hyper extension or pivoting of the rocker beyond a final resting position.

33 Claims, 7 Drawing Sheets

ROOF HINGE ARRANGEMENT AND METHOD OF USING SAME FOR MODULAR HOUSING

BACKGROUND OF THE INVENTION

This invention relates generally to roof constructions, and more particularly, is directed to a hinged roof construction which can be easily transported.

It is well known to produce modular houses in factories. Such modular houses are then transported in sections by means of trailers over open roads. The sections of modular houses are typically box-like components having dimensions of approximately 13 feet, 6 inches wide and 10 feet, 10 inches tall and ranging in length up to approximately 64 feet.

However, there generally are regulations in each state which limit the height of structures travelling on the highways. Accordingly, when transporting such modular sections over the highways, the roof of each section is conventionally attached to the tops of the box-like sections with any of several hinging methods, with the roofs being folded down to rest on the box-like structure in a generally horizontal position As a result, the height of each section is reduced to comply with highway regulations.

Conventionally, a pivot pin or bar is used to hingedly attach the roof of the box-like structure along a single pivot axis. However, such construction is not entirely satisfactory from a structural standpoint, restriction of geometry standpoint, and is cost inefficient. More commonly, a mono hinge truss roof system is used, but it has similar draw backs.

OBJECTS OF THE INVENTION

It is an object of the present invention to provide a roof hinge arrangement for modular housing that overcomes the aforementioned disadvantages with the prior art.

It is another object of the present invention to provide a roof hinge arrangement for modular housing that permits pivotal movement of a roof panel on the modular section in such a manner that permits pivoting above and beyond the final resting position (hyper extension).

It is still another object of the present invention to provide a roof hinge arrangement for modular or other premanufactured housing in which the hinge arrangement includes a plate and rocker pivotally secured together by a flexible strap.

It is yet another object of the present invention to provide a roof hinge arrangement for modular housing that is relatively inexpensive and easy to manufacture and use.

The above and other objects, features and advantages of the present invention will become readily apparent from the following detailed description which is to be read in connection with the accompanying drawings.

SUMMARY OF THE INVENTION

In accordance with an aspect of the present invention, an arrangement for pivotally securing a roof panel to the upper end of a housing frame, includes plate leaf means fixedly secured to the upper end of the housing frame for attaching the roof panel to the upper end of the housing frame; rocker leaf means secured to the roof panel for mounting the roof panel on the plate leaf means; and flexible hinge band means, wrapped and secured about the plate leaf means and the rocker leaf means, for permitting pivotal movement of the rocker leaf means on the plate leaf means along two different pivot axes.

In accordance with another aspect of the present invention, a method of pivotally securing a roof panel to the upper end of a housing frame, includes the steps of fixedly securing plate leaf means to the upper end of the housing frame; fixedly securing rocker leaf means to the roof panel; positioning the rocker leaf means on the plate leaf means; wrapping flexible hinge band means about the plate leaf means and the rocker leaf means; and securing the flexible hinge band means about the plate leaf means and the rocker leaf means so as to permit pivotal movement of the rocker leaf means on the plate leaf means along two different pivot axes.

DETAILED DESCRIPTION

Figure 1:
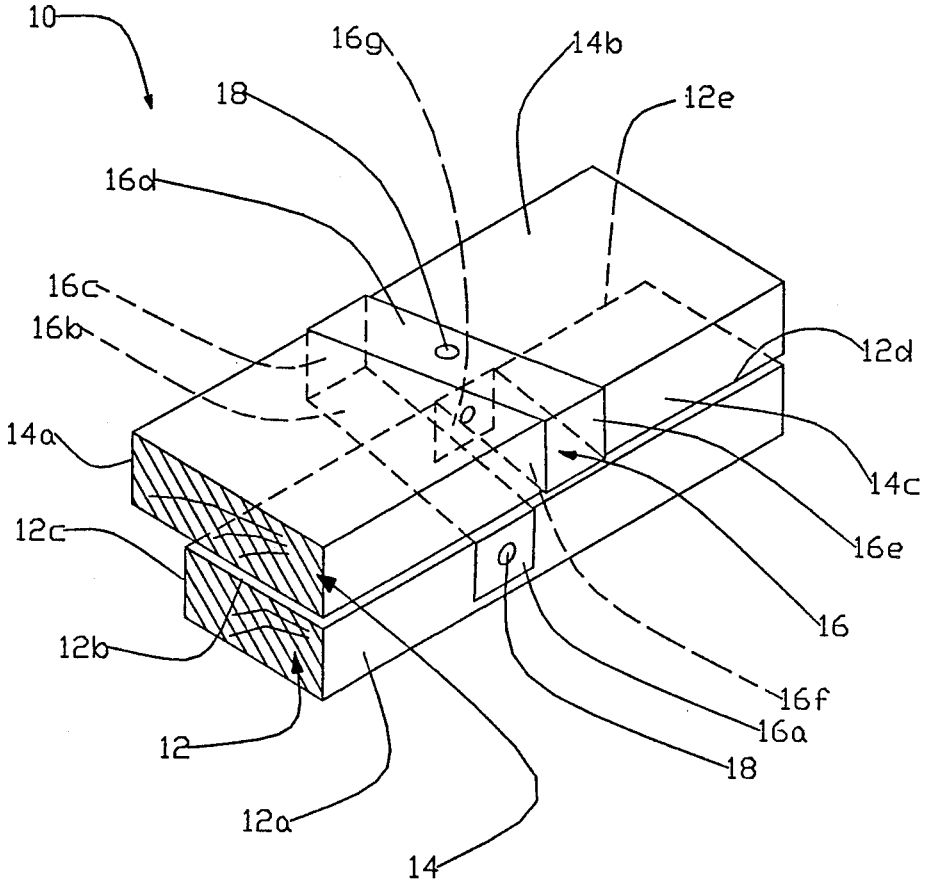
FIG. 1 is a perspective view of a portion of a hinge arrangement according to the present invention.

Referring to the drawings in detail, and initially to FIG. 1 thereof, a hinge arrangement 10 according to the present invention includes a plate 12 which is fixedly secured to the upper end of a ceiling or wall of a modular housing section. Plate 12 extends along the length of one wall and constitutes a lower leaf of the hinge arrangement 10. A rocker 14 constitutes the upper leaf of hinge arrangement 10. Rocker 14 preferably ties the roof rafters together when creating a roof panel and also extends along the length of the same wall.

In accordance with an important aspect of the present invention, a flexible hinge band 16 is wrapped about plate 12 and rocker 14 and secured thereto by any suitable fasteners 18, such as nails, staples or the like, or by an adhesive. Preferably, fasteners 18 are provided at the ends of band 16, and an additional fastener 18 is placed through band 16 at the top of rocker 14 to prevent side to side slipping.

As shown in FIG. 1, hinge band 16 is wrapped about plate 12 and rocker 14 in a figure eight manner. In other words, hinge band 16 includes (a) a section 16*a* extending from one side edge 12*a* of plate 12, (b) a section 16*b* extending over the top 12*b* of plate 12 and between plate 12 and rocker 14 to the opposite side of plate 12 in a direction substantially perpendicular to the lengthwise direction of plate 12, (c) a section 16*c* extending over the opposite side edge 14*a* of rocker 14, (d) a section 16*d* extending over the top 14*b* of rocker 14 in a direction slightly askew from the lengthwise direction of plate 12, (e) a section 16*e* extending down the opposite side edge 14*c* of rocker 14, (f) a section 16*f* extending between plate 12 and rocker 14 in a direction substantially parallel to section 16*b* and adjacent thereto, and (g) a section 16*g* extending down over the opposite side edge 12*c* of plate 12. Of course, it will be appreciated that hinge band 16 is formed by a continuous band, and the above recitation of sections 16*a*–16*g* is merely discussed in order to better explain how hinge band 16 is wrapped about plate 12 and rocker 14 in the aforementioned figure eight configuration.

Hinge band 16 is made from any material which is sufficiently flexible to permit the above wrapping and subsequent movement during use, while being sufficiently strong to withstand the forces encountered during transportation and pivoting. As an example, a fiber such as a woven nylon fabric can be used having a thickness of 1/16 inch and a width of two inches. Plastic or thin flexible metal band material could be used for hinge bands 16. It is also preferred that a plurality of hinge bands 16 be used, with the number and spacing being dependent on the anticipated loads to be encountered. As a general rule, there must be a minimum of two hinge bands 16, with a spacing preferably of four feet between such hinge bands 16.

Figure 2:
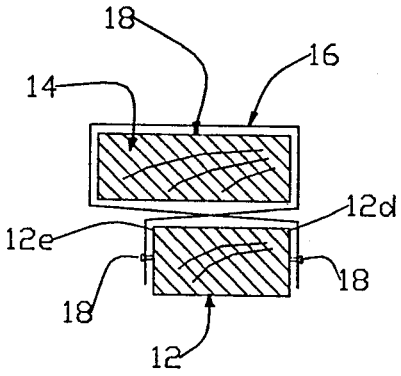
FIG. 2 is an end plan view of the rocker and plate of the hinge arrangement of FIG. 1 in the final assembled position.
Figure 3:
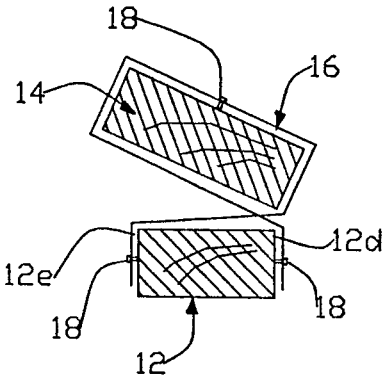
FIG. 3 is an end plan view of the rocker and plate of the hinge arrangement of FIG. 1 in a hyper-extended position.

It will be appreciated that the use of the figure eight wrapping permits rocker 14 to pivot at two corners 12*d* and 12*e* of plate 12, such corners 12*d* and 12*e* constituting two different pivot axes for rocker 14. Thus, as shown in FIG. 2, rocker 14 can assume the position in which it sits flat on plate 12. This corresponds to the final position in which the roof is in the desired operational condition. Rocker 14 can also be pivoted about corner 12*d* of plate 12, as shown in FIG. 3, in which the roof is in its hyper-extended position during erection thereof. Lastly, rocker 14 can be pivoted about corner 12*e* of plate 12, in which the roof is in its folded down position for shipping. Application of hinge arrangement 10 to a typical eave construction of a modular housing section will now be described.

Figure 5:
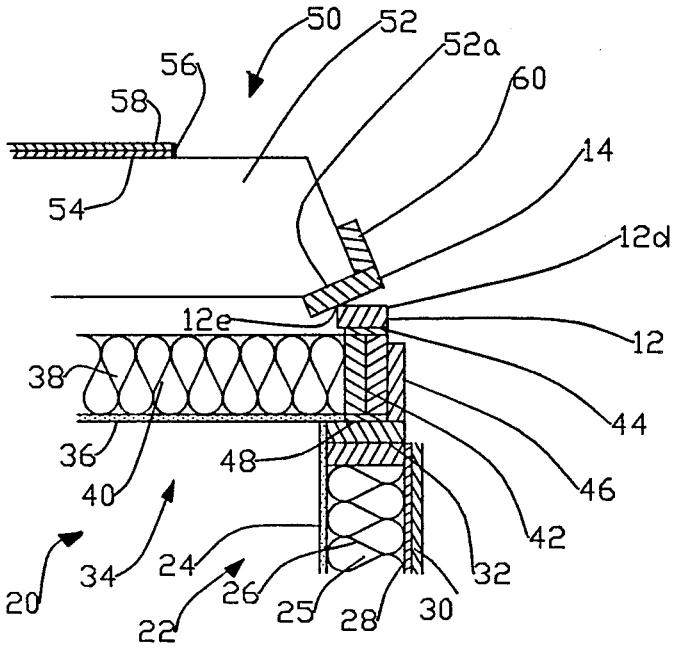
FIG. 5 is schematic sectional view of a portion of a modular housing section with the roof panel thereof pivoted in a folded down position for transportation.

As shown first in FIG. 5, a portion of a modular housing section 20 includes a typical wall panel 22 formed from the inside toward the outside with the following layers: one-half inch gypsum board 24, 2×6 inch studs 25 and batt insulation 26, building paper 28 and one-half inch sheathing 30. A 2×6 inch double plate 32 is formed at the upper end of wall panel 22 immediately above insulation 26 and between gypsum board 24 and building paper 28. Wall panel 22 is of a conventional stud wall construction, with the exception that exterior sheathing 30 is cut to a lower height than gypsum board 24. This is significant in the fire wall construction which will be explained hereinafter with respect to FIG. 10.

Modular housing section 20 further includes a typical ceiling panel 34 formed from the lower end toward the upper end with the following layers: one-half inch gypsum board 36, 2×6 inch studs 38 and batt insulation 40. At the outer edge of insulation 40, rim joists 42 are provided. Ceiling panel 34 is constructed in accordance with the industry standard, with the exception that a shim 44 is optionally added to the upper surface of rim joints 42 at the outer edge thereof, and a piece of 5/4×6 inch wood blocking 46 is added to the outside of rim joists 42, the outer surface of the latter extending substantially coplanar with the outer surface of the wall panel framing. Blocking 46 fills a void that accommodates two layers of ⅝ inch gypsum board in the fire wall detail, to be described hereinafter. It is further noted that gypsum board 36 terminates at the upper end of gypsum board 24, and a plywood bearing strip 48 extends outwardly and coplanar with gypsum board 36 to a position terminating at the outer edge of rim joists 42 and immediately above insulation 26. Ceiling panel 34 is secured to wall panel 22 by any suitable means, such as nails, during construction in the factory, and is transported in such attached condition.

Modular housing section 20 further includes a roof panel 50 formed from the lower end to the upper end thereof with the following layers: studs 52 which form the roof panel proper, sheathing 54, building paper 56 and shingles 58. The outer edge of roof panel 50 also includes a header 60.

In order to pivotally secure roof panel 50 to the outer upper edge of ceiling panel 34, the aforementioned hinge arrangement 10 is used. In this regard, plate 12 is fixedly mounted on shims 44 and rocker 14 is fixedly mounted to the beveled, lower outer edge 52a of studs 52 of roof panel 50, such that the outer edge of rocker 14 is substantially coplanar with the outer edge of header 60. Hinge band 16 is not shown in FIG.. 5 for the sake of clarity.

Figure 4:
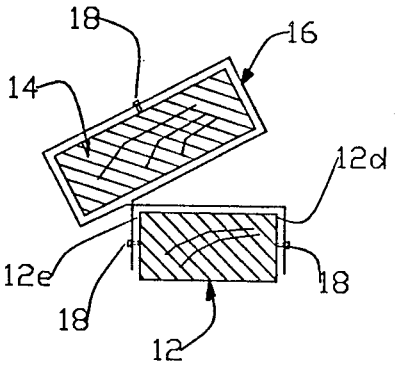
FIG. 4 is an end plan view of the rocker and plate of the hinge arrangement of FIG.. 1 in a folded down position.

As shown in FIG. 5, rocker 14 is pivoted on corner 12*e* of plate 12 to the position shown in FIG. 4, which is the storage and transporting position. In this position, roof panel 50 is substantially parallel with ceiling panel 34. Accordingly, highway height regulations can easily be met, while providing a simple, yet novel, hinge arrangement 10 for roof panel 50.

After modular housing section 20 has been transported to its final site, it is necessary to assemble roof panel 50 in its upright slanted position. In this regard, two housing sections 20 are generally brought together. Prior to bringing the two housing sections 20 together, it is necessary to raise roof panel 50 to the hyper-extended position of FIG. 6. In this position, roof panel 50 is pivoted to a greater angle than its final slant angle. It will be appreciated that rocker 14 in this position is pivoted along the opposite edge 12*d* of plate 12 to the position shown in FIG. 3.

Thereafter, the two modular sections 20 are secured together by nails or the like. In such case, roof panel 50 is pivoted to the lesser angle shown in FIG. 7, which is the final assembled position. Thus, roof panels 50 of the two assembled modular housing sections 20 are secured together by nails or the like. Further, in such position, nails 62 of the like are driven through the top of rocker 14 into plate 12 to secure rocker 14 to plate 12 in such stable, non-pivoted position. This can easily be accomplished since there is space between the rafters 52 of roof panel 50.

Figure 8:
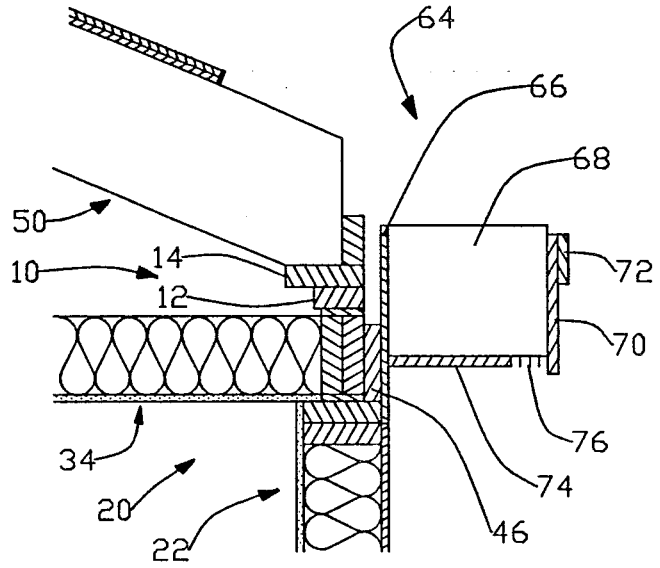
FIG. 8 is a schematic sectional view of the portion of the modular housing section of FIG. 7, with an eave assembly attached thereto.

Thereafter, as shown in FIG. 8, eave assembly 64 is installed on modular housing section 20. Eave assembly 64 is built up on sheathing 30 of wall panel 22, and is formed from the inside to the outside by the following layers: sheathing 66 extending upwardly from sheathing 30 and secured to the outer face of blocking 46, blocking 68, fascia 70, and trim 72 at the upper outer face of fascia 70. A horizontally oriented soffit board 74 is provided at the lower face of blocking 68 and extends approximately two-thirds of the way toward the outer face thereof, followed by a vent strip 76 extending between soffit board 74 and fascia 70.

Figure 9:
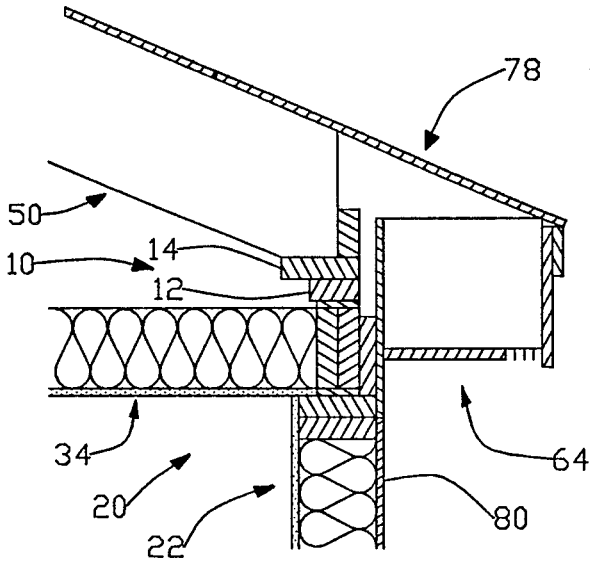
FIG. 9 is a schematic sectional view of the portion of the modular housing section of FIG. 8, with the access panel closed.

With the present invention, although not shown above, there is an access panel, which is a strip of sheathing 54 approximately two feet wide, that can be lifted and folded up onto roof panel 50 to allow access to hinge assembly 10 for final nailing. In such case, as shown in FIG. 9, access panel 78 is thereafter closed. Further, siding 80 or the like can then be secured to the outer face of sheathing 30 of wall panel 22.

Figure 10:
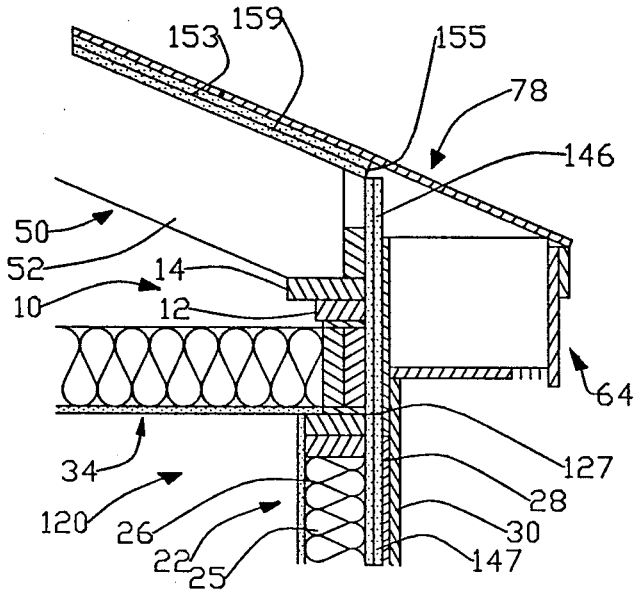
FIG. 10 is a schematic sectional view of a portion of a modular housing section of a fire wall eave construction, with the roof panel thereof in its final assembled position.

It will be appreciated that the present invention can be used with other types of modular housing sections. For example, as shown in FIG. 10, the present invention is shown in conjunction with a modular housing section 120 of a fire wall eave construction, in which elements corresponding to those of modular housing section 20 are identified by the same reference numerals, and a detailed description thereof will be omitted herein for the sake of brevity.

As shown, between studs 25 and sheathing 28, there is provided a double layer of ⅝ inch gypsum board 127. It will be appreciated that the dimensions of studs 25 and insulation 26 must therefore be reduced in size to accommodate gypsum board 127. Further, blocking 46 from ceiling panel 34 is eliminated, and in place thereof, two pre-cut layers of ⅝ inch gypsum board 146 are provided with eave assembly 64. With respect to roof panel 50, the rafters or studs 52 thereof are downsized to accommodate two layers of ⅝ inch gypsum board 153 and an adjacent outer layer of gypsum board 159. The meeting points between gypsum board 127 and gypsum board 146 have a metal T-strip 147 therebetween which is sealed with a gypsum spackle. In like manner, the meeting points between gypsum board 146 and gypsum board 159 have a metal Z-strip 155 therebetween which is sealed with a gypsum spackle.

The erection sequence is generally the same as that described above with respect to FIGS. 5–9, with the following exceptions.

Figure 6:
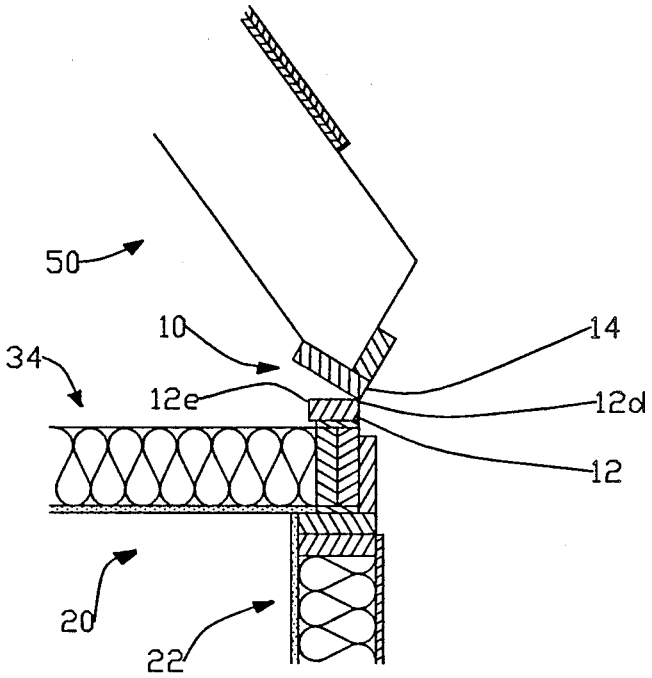
FIG. 6 is a schematic sectional view of a portion of a modular housing section with the roof panel thereof pivoted in a hyper-extended position during assembly.
Figure 7:
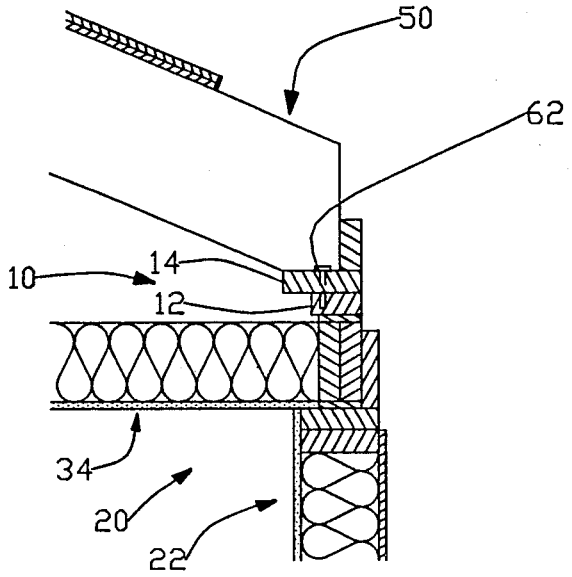
FIG. 7 is a schematic sectional view of a portion of a modular housing section of an eave construction, with the roof panel thereof in its final assembled position.

In the steps of FIGS. 5–7, gypsum boards 127 and 153 have been pre-installed at the factory. Thereafter, between FIG. 7 and FIG. 8, gypsum board 146 is installed, along with the T-strip 147. Then, eave assembly 64 is assembled in place, in the same manner taught in FIG. 8. Thereafter, gypsum board 159 and Z-strip 155 are assembled in place, and finally the access panel is closed as in FIG. 9.

Figure 11:
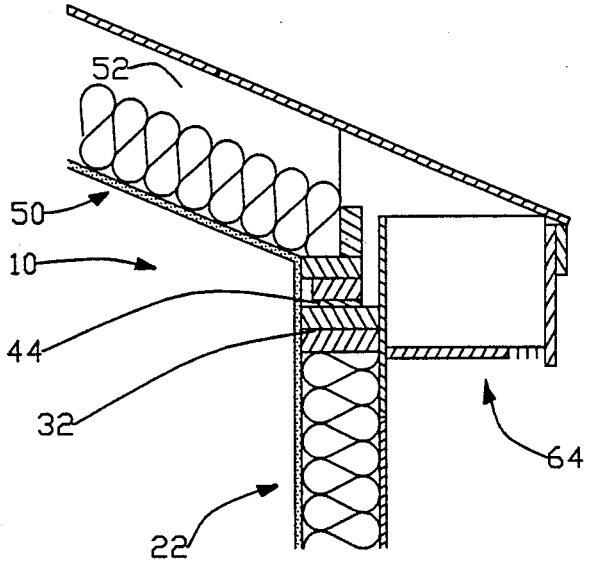
FIG. 11 is a schematic sectional view of a portion of a modular housing section of a cathedral eave construction, with the roof panel thereof in its final assembled position.

As another example, as shown in FIG. 11, the present invention is shown in conjunction with a modular housing section 220 of a cathedral eave construction, in which elements corresponding to those of modular housing section 20 are identified by the same reference numerals, and a detailed description thereof will be omitted herein for the sake of brevity. As shown, ceiling panel 34 is omitted herein. Thus, shims 44 are secured directly on top of double plate 32 of wall panel 22. Further, after the final position of roof panel 50 is attained, roof panel 50 is nailed to the upper end of wall panel 22. The remainder of the construction is generally the same as that described above with respect to modular housing section 20.

Figure 12:
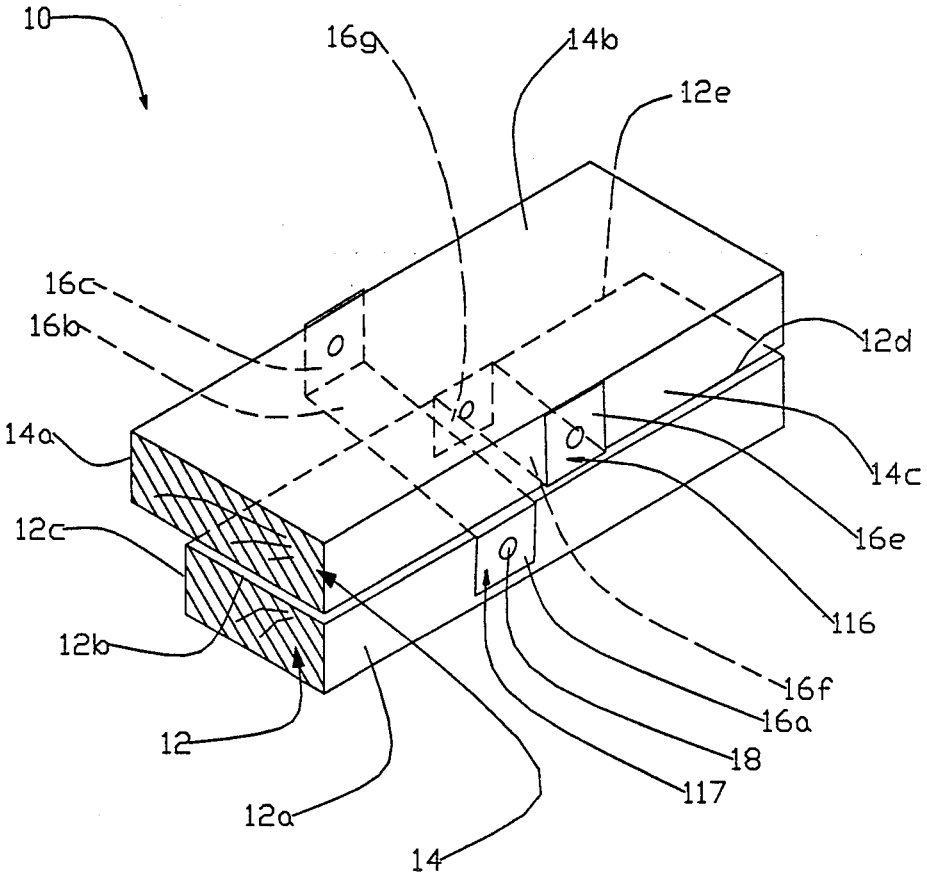
FIG. 12 is a view similar to FIG. 1 of a modified embodiment.

FIG. 12 shows an embodiment similar to FIG.. 1, but wherein the FIG. 8 hinge band 16 is formed by two separate band members 116, 117, to perform substantially the same function. The resultant structure of FIG. 12 provides two "S-shaped" flexible band members in place of the single FIG. 8 member 16 of FIG. 1. The band members 116, 117 of FIG. 12 may be formed of the same type of materials as the band member 16 in FIG. 1, and may be secured in place in the same manner as described hereinabove.

Accordingly, with the present invention, a roof hinge arrangement is provided for modular housing that permits pivotal movement of the roof panel on the ceiling panel or wall panel of a modular section along two different axes, by means of the hinge band in a relatively inexpensive and easy manner.

While the invention is described above with respect to a roof panel which is secured to the upper end of a housing frame, it should be clear that it is equally applicable to other types of panels secured to other portions of a housing frame, for example to an intermediate portion of a housing frame in a hinge-like manner.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. An arrangement for pivotally securing a panel to a housing wall member, said arrangement comprising:

elongated plate leaf means connected to an upper end of the housing wall member for attaching the panel to the housing wall member;

elongated rocker leaf means secured to said panel for mounting said panel on said plate leaf means; and flexible hinge band means, wrapped at least partly about said plate leaf means and at least partly about said rocker leaf means, for coupling together said plate leaf means and said rocker leaf means together;

said flexible hinge band means including a first hinge band portion secured to both said plate leaf means and said rocker leaf means and being flexible relative to both said plate leaf means and rocker leaf means to define with said plate leaf means and rocker leaf means two different pivot axes about which said plate leaf means and rocker leaf means are pivotable relative to each other, which pivot axes are displaced from each other in a direction transverse to the longitudinal direction of said elongated rocker leaf means and plate leaf means, and said first hinge band portion being secured to both said plate leaf means and rocker leaf means to prevent lateral or sidewise relative movement thereof in at least a first transverse direction; and said flexible hinge band means further including a second hinge band portion secured to both said plate leaf means and said rocker leaf means and being flexible relative to both said plate leaf means and rocker leaf means and cooperating with said first hinge band portion to permit said plate leaf means and rocker leaf means to pivot relative to each other about said two different pivot axes, and said second hinge band portion being secured to both said plate leaf means and rocker leaf means to prevent lateral or sidewise relative movement thereof in at least a second transverse direction which is in a direction substantially opposite to said first transverse direction;

whereby said flexible hinge band means permits said pivotal movement of said rocker leaf means on said plate leaf means on said two different pivot axes, and said flexible hinge band means also serves as a restraining means for substantially preventing said lateral or sidewise movement of said rocker leaf means relative to said plate leaf means in at least said first and second transverse directions.

2. An arrangement according to claim 1, wherein said plate leaf means is elongated includes opposite spaced apart corners of elongated edges defining said two different pivot axes.

3. An arrangement according to claim 1, wherein said flexible hinge band means includes a single flexible strap wrapped about said plate leaf means and said rocker leaf means substantially in a figure eight configuration for permitting said pivotal movement said single flexible strap comprising said first and second hinge band portions.

4. An arrangement according to claim 3, wherein said single strap is wrapped so as to include a first section extending over one said edge of said plate leaf means, a second section extending between said plate leaf means and said rocker leaf means, a third section extending over one side edge of said rocker leaf means, a fourth section extending over a top surface of said rocker leaf means, a fifth section extending over an opposite side edge of said rocker leaf means, a sixth section extending between said plate leaf means and said rocker leaf means and being substantially parallel and adjacent to said second section, and a seventh section extending down over an opposite side edge of said plate leaf means.

5. An arrangement according to claim 1, wherein said hinge band means includes a flexible strap made from a sheet member.

6. An arrangement according to claim 5, wherein said sheet member is a fabric.

7. An arrangement according to claim 5, wherein said sheet member is a woven fabric.

8. An arrangement according to claim 1, wherein said hinge band means includes a plurality of flexible straps separated from each other by a predetermined distance along said plate leaf means and said rocker leaf means.

9. An arrangement according to claim 1, wherein said plate leaf means and rocker leaf means each have side edges, and wherein said hinge band means is secured to said plate leaf means and said rocker leaf means along said side edges thereof.

10. An arrangement according to claim 1, wherein said housing wall member includes a wall panel, said panel is a roof panel, and said plate leaf means is secured to an upper end of said wall panel.

11. An arrangement according to claim 1, wherein said housing wall member includes a wall panel and a ceiling panel secured on top of the wall panel, and said plate leaf means is secured to an upper face of said ceiling panel.

12. An arrangement according to claim 1, wherein said first and second hinge band portions comprises respective separate hinge bands, each wrapped and secured about at least a portion of said plate leaf means and said rocker, and each being generally S-shaped, said S-shaped hinge bands being arranged to cooperate with each other to provide said pivotal movement about said two different pivot axes and to restrain said plate leaf plate means and rocker relative to each other.

13. An arrangement according to claim 3, wherein said flexible strap is a fabric strap.

14. An arrangement according to claim 3, wherein said hinge band means includes a plurality of said single flexible straps separated from each other by a predetermined distance along said plate leaf means and said rocker leaf means.

15. An arrangement according to claim 4, wherein said hinge band means includes a plurality of said single flexible straps separated from each other by a predetermined distance along said plate leaf means and said rocker leaf means.

16. An arrangement according to claim 3, wherein said plate leaf means and rocker leaf means each have side edges, and wherein said flexible straps is secured to said plate leaf means and said rocker leaf means along said side edges thereof.

17. An arrangement according to claim 3, wherein said frame section includes a wall panel, said panel is a roof panel, and said plate leaf means is secured to an upper end of said wall panel.

18. An arrangement according to claim 3, wherein said frame section includes a wall panel and a ceiling panel secured on top of the wall panel, and said plate leaf means is secured to an upper face of said ceiling panel.

19. A method of pivotally securing a panel to a housing frame, said method comprising the steps of:

fixedly securing an elongated plate leaf means to the housing frame;

fixedly securing an elongated rocker leaf means to said panel;

positioning said rocker leaf means on said plate leaf means;

wrapping flexible hinge band means at least partly about said plate leaf means and at least partly about said rocker leaf means for coupling together said plate leaf means and said rocker leaf means, said flexible hinge band means including first and second hinge band portions; and securing said first hinge band portion to both said plate leaf means and said rocker leaf means so as to flexibly couple said rocker leaf means and said plate leaf means together, and defining with said rocker leaf means and said plate leaf means two different pivot axes and to prevent lateral or sidewise movement of said rocker leaf means relative to said plate leaf means in at least a first transverse direction; and securing said second hinge band portion to both said plate leaf means and said rocker leaf means and so as to be flexible relative to both said plate leaf means and rocker leaf means, said second hinge band portion cooperating with said first hinge band portion to permit said plate leaf means and rocker leaf means to pivot relative to each other about said two different pivot axes, and said second hinge band portion being secured to both said plate leaf means and rocker leaf means to prevent lateral or sidewise relative movement thereof in at least a second transverse direction which is in a direction substantially opposite to said first transverse direction;

whereby said flexible hinge band means permits said pivotal movement of said rocker leaf means on said plate leaf means on said two different pivot axes, and said flexible hinge band means also serves as a restraining means for substantially preventing said lateral or sidewise movement of said rocker leaf means relative to said plate leaf means in at least said first and second transverse directions.

20. A method according to claim 19, wherein said plate leaf means has opposite spaced apart corners or longitudinal edges, and said steps of wrapping and securing include the steps of wrapping and securing said flexible hinge band means such that said two different pivot axes are constituted by said opposite corners or longitudinal edges of said plate leaf means.

21. A method according to claim 19, wherein said steps of wrapping and securing include the step of wrapping a flexible strap about said plate leaf means and said rocker leaf means substantially in a figure eight configuration.

22. A method according to claim 15, wherein said steps of wrapping and securing includes the step of wrapping said strap over one side edge of said plate leaf means, between said plate leaf means and said rocker leaf means, over one side edge of said rocker leaf means, over a top surface of said rocker leaf means, over an opposite side edge of said rocker leaf means, between said plate leaf means and said rocker leaf means and substantially parallel and adjacent tot he previous portion extending between said plate leaf mans and said rocker leaf means, and down over an opposite side edge of said plate leaf means.

23. A method according to claim 19, wherein said steps of wrapping and securing include the steps of wrapping and securing a plurality of flexible straps separated from each other by a predetermined distance along said plate leaf means and said rocker leaf means.

24. A method according to claim 19, wherein said plate leaf means and rocker leaf means each have side edges, and wherein step of securing includes the step of securing said hinge band means to said plate leaf means and said rocker leaf means along said side edges thereof.

25. A method according to claim 19, wherein said housing frame comprises a all panel having an upper end, and wherein said step of fixedly securing said plate leaf means includes the step of fixedly securing said plate leaf means to said upper end of said wall panel of said housing frame.

26. A method according to claim 12, wherein said housing frame comprises a ceiling panel having an upper face, and wherein said step of fixedly securing said plate leaf mans includes the step of fixedly securing said plate leaf means to said upper face of said ceiling panel of said housing frame.

27. A method according to claim 15, wherein said step of wrapping and securing include the steps of wrapping and securing said first and second hinge band portions separated from each other by a predetermined distance along said plate leaf means and said rocker leaf means.

28. A method according to claim 21, wherein said flexible strap is a fabric strap.

29. A method according to claim 21, wherein said step of wrapping and securing includes the steps of wrapping and securing a plurality of said flexible straps separated from each other by a predetermined distance along said plate leaf means and said rocker leaf means.

30. A method according to claim 22, wherein said step of wrapping includes wrapping a plurality of said flexible straps separated from each other by a predetermined distance along said plate leaf means and said rocker leaf means.

31. A method according to claim 21, wherein said plate leaf means and rocker leaf means each have side edges, and wherein said step of securing includes securing said flexible strap to said plate leaf means and said rocker leaf means along said side edges thereof.

32. A method according to claim 13, wherein said housing frame includes a wall panel, said panel is a roof panel, and said plate leaf means is secured to an upper end of said wall panel.

33. A method according to claim 15, wherein said housing frame includes a wall panel and a ceiling panel secured on top of the wall panel, and said plate leaf means is secured to an upper face of said ceiling panel.

* * * * *